US007106272B2

(12) United States Patent
Noro et al.

(10) Patent No.: US 7,106,272 B2
(45) Date of Patent: Sep. 12, 2006

(54) ANTENNA UNIT

(75) Inventors: Junichi Noro, Akita (JP); Yuichi Saito, Akita (JP); Kyuichi Sato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/785,935

(22) Filed: Feb. 26, 2004

(65) Prior Publication Data

US 2004/0246196 A1 Dec. 9, 2004

(30) Foreign Application Priority Data

Jun. 3, 2003 (JP) ..... P.2003-157582

(51) Int. Cl.
*H01Q 1/42* (2006.01)

(52) U.S. Cl. ..... 343/872; 343/878; 343/711; 343/713

(58) Field of Classification Search ..... 343/787, 343/713, 888, 715, 872
See application file for complete search history.

(56) References Cited

U.S. PATENT DOCUMENTS 5,990,629 A * 11/1999 Yamada et al. ..... 315/169.3
6,329,954 B1 * 12/2001 Fuchs et al. ..... 343/725
6,331,838 B1 * 12/2001 Scott et al. ..... 343/715
6,714,171 B1 * 3/2004 Haussler et al. ..... 343/888
6,756,738 B1 * 6/2004 Maede et al. ..... 315/169.1
6,762,727 B1 * 7/2004 Rochford et al. ..... 343/713
6,879,301 B1 * 4/2005 Kozlovski ..... 343/878
2002/0014849 A1 * 2/2002 Tsujikawa et al. ..... 315/169.1
2003/0184236 A1 * 10/2003 Maede et al. ..... 315/169.1

* cited by examiner

*Primary Examiner*—Don Wong
*Assistant Examiner*—Binh Van Ho
(74) *Attorney, Agent, or Firm*—Whitham, Curtis, Christofferson & Cook, PC

(57) ABSTRACT

A new attachment structure for an antenna unit includes a gasket that prevents entry of water and is configured to have an improved external appearance. An antenna unit includes an antenna module which receives radio waves transmitted from a satellite and a cover member which has inner space large enough to house the antenna module. The cover member has an opened bottom surface which joins with a bottom plate that closes the opened bottom surface of the cover member. A gasket covers at least a periphery of the bottom plate. The gasket comes into contact with the inner surface of the cover member to seal the inner space. Because the gasket does not have a cover portion which covers the outer surface of the cover member, the problem of reduced waterproofed quality when the cover portion is pulled can be prevented, while also providing a fine appearance.

7 Claims, 3 Drawing Sheets

ANTENNA UNIT

BACKGROUND OF THE INVENTION

1. Field or the Invention

The present invention relates to an antenna unit which receives radio waves transmitted from a satellite, and particularly to an antenna unit suitable for a car antenna attached onto an automotive roof.

2. Description of the Related Art

In car navigation systems, the present position is specified by speed and running distance of the car, while, in order to improve accuracy of position, radio waves transmitted from a GPS (global positioning system) satellite are received and the present position is specified also by the position data obtained from the received radio waves.

Recently, in the USA, it has been promoted to provide digital radio broadcasting by radio waves transmitted from an earth satellite. Also, in a digital radio receiving system which receives such the digital radio broadcasting, an antenna for receiving radio waves transmitted from the satellite is still required, and a so-called satellite radio broadcasting reception antenna is used.

The radio wave from the satellite, since a high-frequency band is used, has high directivity. Accordingly, in the car navigation system and the digital radio receiving system, in order to receive the radio waves from the satellite in a good reception state, it is necessary to attach a reception antenna onto a top surface (i.e., roof) of the car. Therefore, for the antenna unit for receiving the radio waves from the satellite, high atmospheric corrosion resistance and waterproof property are necessary.

As a conventional waterproof countermeasure in this kind of antenna unit, it is general to use a gasket (packing) composed of rubber, and attachment structure as shown in FIG. 6 is widely adopted. Namely, a bottom surface of a cover member 101 in which an antenna module for receiving radio waves transmitted from the satellite is housed is sealed by a bottom plate 103 to which a gasket 102 is attached, and the antenna unit is set onto a roof panel 104 of a car thereby to prevent entry of water. At this time, as shown in FIG. 7, a slit 102*a* is provided for the gasket 102 thereby to provide double structure, and an end 101*a* on the bottom side of the cover member 101 is inserted into this slit 102*a* thereby to secure the sealing state.

However, in case that the aforesaid waterproof structure is adopted, the surroundings near the bottom surface of the cover member 101 are covered with a cover part 102*b* of the gasket 102 like a skirt, and such mischief that this skirt-like portion is pulled by a hand has been frequently reported. In case that the cover part 102 of the gasket 102 is pulled, there is fear that a waterproof function is damaged, which is a large problem.

Further, the state in which the surroundings near the bottom surface of the cover member 101 are covered with the cover part 102*b* like the skirt mare the appearance greatly. Further, also from a viewpoint of the waterproof function, there is a problem that water easily enters the inside of the cover member 101 from a gap between the cover part 102*b* and the cover member 101, and improvement of this problem is desired.

SUMMARY OF THE INVENTION

The invention, in view of such the conventional circumstances, has been proposed, and it is an object of the invention to provide new attachment structure of a gasket which can surely prevent entry of water without fear of the mischief and is superior in appearance thereby to provide an antenna unit which is high in reliability.

In order to achieve the above object, an antenna unit according to the invention includes an antenna module which receives radio waves transmitted from a satellite or the earth, a cover member which has an inner space large enough to house the antenna module and has an opened bottom surface, and a bottom plate which closes the opened bottom surface of the cover member, and the antenna unit is characterized in that a gasket which covers at least a periphery of the bottom plate is arranged, and this gasket comes into contact with the inner surface of the cover member thereby to seal the inner space.

In the antenna unit of the invention, the gasket is built into the bottom surface side of the cover member, and the gasket comes into contact the inner surface of the cover member thereby to prevent entry of water. Therefore, since the cover part which covers the outer surface of the cover member does not exist, the mischief of pulling this cover part is prevented. Simultaneously, the fine appearance is also secured. Further, since a boundary portion between the cover member and the gasket does not face to the outside, there is no rear that the water enters the inside of the cover member from the gap between the cover member and the gasket.

DESCRIPTION OF THE PREFERRED EMBODIMENTS

An antenna unit to which the invention is applied will be described below in detail with reference to drawings.

Figure 1:
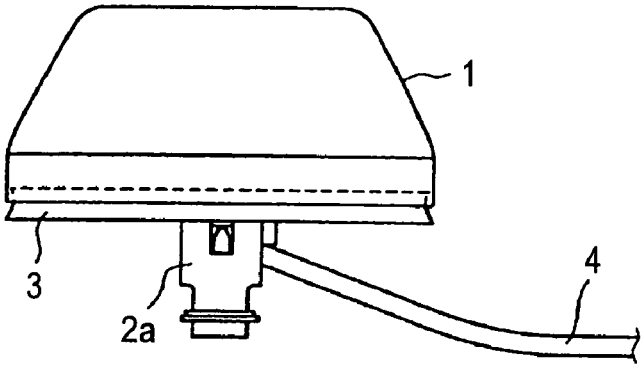
FIG. 1 is a side view showing one example of an antenna unit to which the invention is applied.
Figure 2:
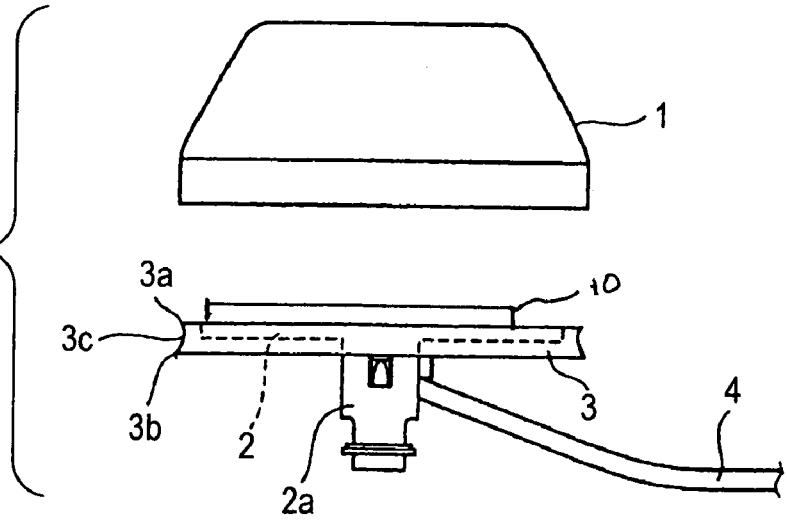
FIG. 2 is a side view showing the exploded antenna unit to which the invention is applied.

An antenna unit in this embodiment, as shown in FIGS. 1 and 2, comprises an antenna module 10 which receives radio waves transmitted from a satellite, a cover member 1 which has inner space of size enough to house the antenna module 10 and has an opened bottom surface, a bottom plate 2 which closes the opened bottom surface of the cover member 1, and a gasket 3 which covers a periphery and a bottom surface of this bottom plate 2.

The gasket 3 is arranged so as to cover the periphery of the bottom plate 2 and comes into contact with the inner surface of the cover member 1 thereby to seal the inner space in which the antenna module 10 is housed. The bottom plate 2 to which the gasket has been attached is attached to the cover member 1 so as to be built into the opened bottom surface of the cover member 1. As shown in FIG. 1, when the antenna unit has been attached to an automotive roof, the gasket 3 can be hardly seen from the outside.

Figure 5:
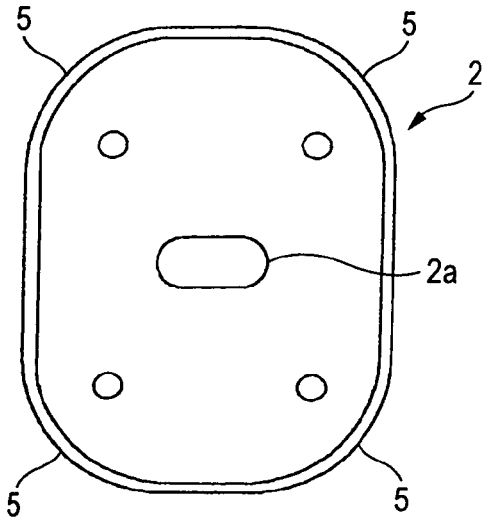
FIG. 5 is a top view of a bottom plate in the antenna unit to which the invention is applied.
Figure 6:
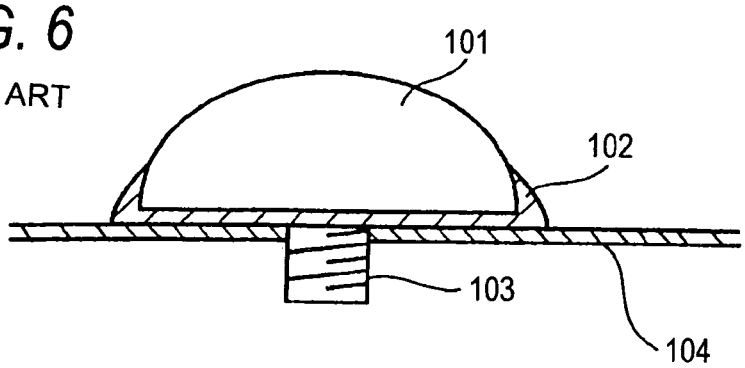
FIG. 6 PRIOR ART
FIG. 6 is a side view showing a conventional antenna unit.
Figure 7:
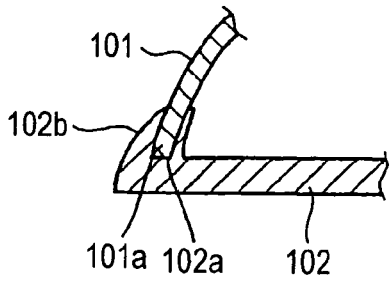
FIG. 7 PRIOR ART
FIG. 7 is a main portion sectional view showing an enlarged seal portion between a cover member and a gasket in the conventional antenna unit.

In the gasket 3, as shown in FIG. 2, an upper end 3*a* and a lower end 3*b* in the thickness direction of the bottom plate 2 are larger in dimension than other portions, and an external dimension W1 of the lower end 3*b* is set a little larger than an opening dimension W2 of the opened bottom surface of the cover member 1. Further, the lower end 3*b* side of the gasket 3 has a slant surface 3*c* which becomes larger in dimension toward the lower end 3*b*. Further, as shown in FIGS. 3 and 5, the bottom plate 2 has a different-in-level portion 5 at the entire periphery of its edge, and the gasket 3 is attached to the bottom plate 2 and held so that an edge portion of the gasket 3 covers the different-in-level portion 5.

Figure 3:
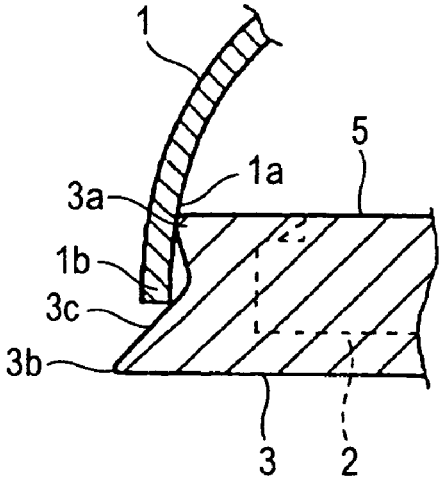
FIG. 3 is a main portion sectional view showing an enlarged seal portion between a cover member and a gasket.

Therefore, in case that the bottom plate 2 to which the gasket 3 has been attached is pushed into the opened bottom surface of the cover member 1, as shown in FIG. 3 of an enlarged view, the upper end 3*a* of the gasket 3 is brought into pressure-contact with the inner surface 1*a* of the cover member 1, and the lower end edge 1*b* of the cover member is brought into contact with the slant surface 3*c*. Hereby, at two positions, that is, at the position where the lower end edge 1*b* of the cover member 1 comes into contact with the slant surface 3*c* and at the position where the upper end 3*a* of the gasket 3 is brought into pressure-contact with the inner surface 1*a* of the cover member 1*a*, the inner space of the cover member is sealed. Therefore, the inner space is sealed double and it is possible to prevent water from entering the inside of the cover member 1 surely.

Figure 4:
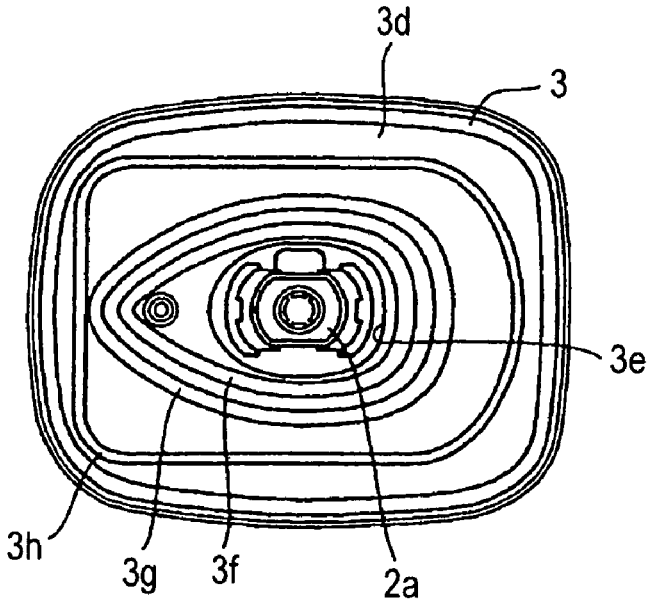
FIG. 4 is a bottom view of the antenna unit to which the invention is applied.

Further, the gasket 3 has a setting surface 3*d* which covers the bottom surface of the bottom plate 2. When the antenna unit is attached onto an automotive roof, this setting surface 3*d* is interposed between the bottom plate 2 and the automotive roof and functions as packing. At this time, at the bottom plate 2, a boss 2*a* for leading the connection cable 4 into a car is formed. As shown in FIG. 4, correspondingly to the boss 2*a*, an opening portion 3*e* is formed in the setting surface 3*d*. Accordingly, there is fear of entry of the water from this opening portion 3*e*.

Therefore, in the embodiment, on the setting surface 3*d*, plural ring protrusions are formed so as to surround the opening portion 3*e* of the setting surface 3*d*, and herein a triple protrusion 3*f*, 3*g*, 3*h* is formed thereby to prevent entry of the water from this opening portion 3*e*. Namely, the opening portion 3*e* of the setting surface 3*d* is sealed threefold by attaching these protrusions 3*f*, 3*g*, and 3*h* onto the automotive roof proof closely, whereby the water is surely prevented from entering the inside of the cover member 1 from this opening portion 3*e*.

As clear from the above description, in the antenna unit of the invention, the gasket is built into the bottom surface of the cover member, and the cover portion which covers the outer surface of the cover member does not exist. Therefore, such mischief that this cover portion is pulled by a hand can be surely prevented. Accordingly, it is possible to prevent deterioration or waterproof property caused by the mischief, and this gasket attachment structure is very effective for prevention of the mischief.

Further, absence of the cover portion which covers the outer surface of the cover member provides a large merit on appearance. Further, since the gasket can be hardly seen from the outside, in case that the antenna unit has been attached onto the automotive proof, the appearance is not marred.

Further, in the antenna unit of the invention, the inner space of the cover member is double sealed by the peripheral edge portion of the gasket, and the boundary portion between the cover member and the gasket does not face to the outside. Therefore, there is no fear that the water enters the inside of the cover member from the gap between the cover member and the gasket, and good waterproof property and atmospheric corrosion resistance can be given, so that it is possible to provide the antenna unit which is high in reliability.

What is claimed is:

1. An antenna unit comprising:

an antenna module;

a cover, formed with an inner face and an opening which define an inner space for housing the antenna module;

a bottom plate having a top surface, a bottom surface and a peripheral edge;

a gasket having an inner surface that fits over and encircles the peripheral edge of said bottom plate, and an outer surface which is brought into contact with the inner face of the cover.

2. The antenna unit according to claim 1, wherein:

the inner face of the cover comprises a first part and a second part;

the outer surface of the gasket comprises a first part brought into contact with the first part of the inner face, and a second part brought into contact with the second part of the inner face of the cover.

3. The antenna unit according to claim 1, wherein:

the bottom plate comprises a mounting face opposed to an object face on which the antenna unit is mounted;

the cover comprises an edge which defines the opening;

an outer dimension of the outer surface of the gasket is enlarged toward the mounting face while forming a slant face; and the edge of the cover is brought into contact with the slant face.

4. The antenna unit according to claim 1, further comprising:

a cable, electrically connected with the antenna module, wherein the base plate comprises an opening through which the cable is led out and a mounting face to be opposed to an object face on which the antenna unit is mounted; and the gasket comprises plural annular protrusions surrounding the opening.

5. The antenna unit according to claim 1, wherein the bottom plate includes different in level portion at said outer periphery.

6. The antenna unit of claim 1 the inner face of the cover is contacted by the gasket only inside said opening in said cover.

7. The antenna unit of claim 1 wherein said gasket covers a bottom surface of said bottom plate.

* * * * *